US007484262B2

(12) United States Patent
Cotton

(10) Patent No.: US 7,484,262 B2
(45) Date of Patent: Feb. 3, 2009

(54) DEVICE FOR CLEANING GOLF CLUB HEADS AND GOLF BALLS

(76) Inventor: David Cotton, 948 E. 141st, Cleveland, OH (US) 44110

( * ) Notice: Subject to any disclaimer, the term of this patent is extended or adjusted under 35 U.S.C. 154(b) by 522 days.

(21) Appl. No.: 10/856,875

(22) Filed: Jun. 1, 2004

(65) Prior Publication Data

US 2005/0262654 A1 Dec. 1, 2005

(51) Int. Cl.
*A63B 47/04* (2006.01)
*A63B 57/00* (2006.01)

(52) U.S. Cl. ..... 15/118; 15/209.1; 15/210.1

(58) Field of Classification Search ..... 15/209.1, 15/210.1, 118, 244.3
See application file for complete search history.

(56) References Cited

U.S. PATENT DOCUMENTS 2,530,746 A * 11/1950 Wetherby ..... 15/104.94
2,942,285 A * 6/1960 Gray ..... 15/229.11
2,958,885 A * 11/1960 Donney ..... 401/196
2,968,825 A * 1/1961 Wetherby ..... 15/118
3,169,264 A * 2/1965 Walker ..... 15/118
3,514,802 A * 6/1970 Keech ..... 15/118
3,806,983 A * 4/1974 Cunningham et al. ..... 15/160
4,170,317 A 10/1979 Fisher
5,075,918 A 12/1991 Zeltner et al.
5,898,968 A 5/1999 Beattie
5,979,008 A 11/1999 Gordon
6,226,827 B1 * 5/2001 English, Jr. ..... 15/118
6,233,774 B1 * 5/2001 Vogt ..... 15/104.93
6,594,851 B2 * 7/2003 Sprague ..... 15/210.1
2004/0016071 A1 * 1/2004 Ayala ..... 15/104.93
2005/0198758 A1 * 9/2005 Kunz ..... 15/118

FOREIGN PATENT DOCUMENTS

GB 2313065 * 11/1997
GB 2368536 * 5/2002

* cited by examiner

*Primary Examiner*—Mark Spisich
(74) *Attorney, Agent, or Firm*—Price, Heneveld, Cooper, DeWitt & Litton, LLP

(57) ABSTRACT

A device for cleaning golf balls and golf club heads, said device able to be releasably attached to a golf cart or worn or carried by a person playing golf. The device includes a generally rectangular sack having first and second opposed shorter edges and first and second opposed longer edges, the sack further comprised of first and second flexible panels joined along the outer edges thereof and enclosing an interior compartment located proximate to a shorter second edge thereof. An opening with fastener is located on the first panel over the interior compartment. A liquid impervious container is located within the interior compartment and includes an opening with surrounding fastener on a middle wall thereof. The opening of the container is co-aligned with the opening of the first panel. A flexible absorbent panel and flexible mesh panel are stored within the container, the flexible mash panel folded inside the absorbent panel. The absorbent panel contains a quantity of cleaning solution that dissolves dirt and debris adhered to the exterior surface of a golf ball and golf club head. The mesh panel is further comprised of a network of elongate arms and intervening spaces, the elongate arms providing a cutting edge, which in conjunction with the cleaning solution remove dirt and debris from a golf ball or golf club head when said ball or head are inserted through the co-aligned openings and into the folded mesh panel stored within the container.

8 Claims, 5 Drawing Sheets

DEVICE FOR CLEANING GOLF CLUB HEADS AND GOLF BALLS

BACKGROUND OF THE INVENTION

This version of the invention is concerned with the field of golf accessories. More specifically, this version of the invention is concerned with a portable device for cleaning golf club heads and golf balls, said device designed to be releasably attached to golf bags or articles of clothing of a golfer or wrapped around the neck of a golfer.

PRIOR ART

During the playing of golf, it is common for various playing instruments to become soiled with dirt, grass, mud, debris, and the like as the game progresses over a golf course of turf or other natural ground surface. The heads of various golf clubs, while making contact with a golf gall, frequently strike the turf or ground surface and pick up mud, grass blades, sand, or other debris, which adhere to the surface of the golf club head. If the golf club head does not make a clean hit on the golf ball, it will frequently slice into the golf turf and pick up a significant amount of dirt, grass, or debris. At any rate, the golf club head will become soiled, and as the dirt, grass, or debris dry out, removal of the dirt, grass, or debris will become especially difficult as the drying out process serves to bond the dirt, grass, and debris to the golf club head.

Similarly, a golf ball that is struck by a golf club head will collect dirt, grass, and debris on the outer surface thereof as the golf club head upon striking the golf ball will deposit any dirt, grass, or debris that it picks up from the ground surface or turf onto the golf ball. Additionally, as the golf ball rolls across the turf after being struck by the golf club head, it will pick up dirt, grass, and other debris from the ground surface.

As a result, golf club heads and golf balls must be cleaned regularly to ensure optimum playing conditions, to prevent dirt from being transferred onto the person or clothing of people playing golf, and to provide a generally clean and aesthetic appearance. Various devices and methods have been made available in the recent past to perform this function and consist of brushes, towels, pouches, and the like that may or may not be attached to a golf club bag, golf cart, or the like.

A first device and method of cleaning a golf club head and golf ball involves use of a brush with a plurality of bristles that makes contact with a golf club head or golf ball as the brush is passed over the golf club head and golf ball, the movement of which functions to remove dirt, grass, or debris attached thereon. This device is less than satisfactory as it is necessary to hold the golf club head or golf ball with a first hand and the brush with a second hand and stroke the brush over the golf club head or golf ball, ensuring that the brush bristles make continual contact with the golf club head or golf ball. As the dirt, grass, or debris is removed, it is flung into the air by the stroking action of the brush and the bristles and by the resiliency of the brush bristles, which continually shift to retain their initial position when not making contact with the golf club head or golf ball. Consequently, this airborne dirt, grass, or debris may deposit onto the person performing the cleaning or adjacent golf equipment, thereby requiring additional cleaning. Furthermore, if a cleaning solution or solvent is used to moisten and aid in the removal of the dirt, grass, and debris, the soiled solution may also become airborne by the action of the bristles and stain the clothing of a user or nearby golfer and adjacent golf equipment.

A second device and method of cleaning involves placing a golf club head or golf ball into a pouch or sack and then removing the dirt, gross, or debris attached thereon by wiping the golf club head or golf ball with the interior surface of the sack or pouch, by manipulating the golf club head or golf ball within an interior compartment of the sack or pouch to separate dirt, grass, or debris attached thereon, or a combination of the two aforementioned methods. This device and method is generally less than effective as the cleaning of the golf club head and golf ball is accomplished by frictionally engaging the interior surface of the pouch with the surface of the golf club head and golf ball, the action of which may not be sufficient to remove dirt or grime that has bonded to the golf club head or golf ball or has accumulated in significant quantity thereon, as such cleaning is provided without the benefit of a liquid or aqueous cleaning solution to act as a solvent.

The subject of the instant invention overcomes the aforementioned disadvantages of prior devices and apparatuses for cleaning golf club heads and golf balls by providing a device into which a golf club head or golf ball can be inserted and cleaned of dirt, grass, or debris attached thereon by manipulating the golf club head or golf ball within an interior compartment and container of the device with such cleaning accomplished by the combination of an irregular surface of a mesh panel and an adjacent absorbent panel saturated with cleaning solution or solvent, said mesh panel and absorbent panel disposed within the container.

DISCUSSION OF THE PRIOR ART

Numerous designs for cleaning golf club heads and golf balls have been provided in the prior art. Even though these designs may be suitable for the specific individual purposes to which they address, they would not be suitable for the purposes of the present version of the invention as such designs employ brushes, pouches, and bags as referenced earlier in this disclosure. Such designs are exemplified by U.S. Pat. No. 5,075,918, Combination Cleaning Towel And Carrying Case With Construction Method Therefore, issued to Zeltner et al. on 31 Dec. 1991; U.S. Pat. No. 5,898,968, Accessory For Cleaning Golf club Heads And Golf Balls, issued to Beattie on 4 May 1999; U.S. Pat. No. 5,979,008, Golf Club Cleaning Apparatus, issued to Gordon on 9 Nov. 1999; and U.S. Pat. No. 6,226,827, Golfer's Personal Cleaning Device, issued to English, Jr. on 8 May 2001.

As such, it may be appreciated that there is a continuing need for a new and improved device for cleaning golf club heads and golf balls that accomplishes said cleaning by the combination of an irregular surface of a mesh panel and cleaning solution or solvent provided by an adjacent absorbent panel, both panels disposed within a liquid-impervious container that is situated within an interior compartment of the device. In these respects, the present version of the invention substantially departs from the conventional concepts and designs of the prior art, and in so doing provides an apparatus that substantially fulfills this need. Additionally, the prior patents and commercial techniques do not suggest the present inventive combination of component elements arranged and configured as disclosed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

The present version of the invention, which will be described in greater detail hereinafter, relates to the field of golf accessories. More specifically, this version of the invention is concerned with a portable device for cleaning golf club heads and golf balls, said device designed to be releasably attached to golf bags or articles of clothing of a golfer or wrapped around the neck of a golfer. My version of the invention overcomes all of the shortcomings listed previously, in addition to novel aspects that will be described in detail hereinafter.

Described briefly, according to a first embodiment, the invention presents a device for cleaning golf club heads and golf balls. The device is comprised of a rectangular sack having two rectangular panels of flexible, absorbent textile material, such as terry cloth towel or the like, which are attached in mirror arrangement to each other at a common seam at the perimeter edges thereof. One of the panels of material is provided with an opening or slit proximate to one end thereof, said opening providing access to an interior compartment or cavity located between the attached panels of material and proximate to one end thereof. A VELCRO® fastener is affixed to the panel of material on either side of the opening. Two grommets are located medially within the panels so that when the panels are folded in half the grommets co-align in order to permit a clip to inserted therethrough. The clip can then be releasably attached to a golf club bag to hang the device upon the bag for easy access and use by one or more golfers.

A flexible, liquid-impervious container with an opening slit and adjacent VELCRO® fastener is disposed within the interior compartment located between the two panels of material. An absorbent panel and a mesh panel are folded in half and situated within the liquid-impervious container. The absorbent panel is saturated with a quantity of cleaning solution or solvent so as to facilitate removal of dirt, grass, or debris.

A golf club head or golf ball is inserted into the liquid-impervious container between opposed sides of the mesh panel and cleaned by manipulating the golf club head or golf ball against the irregular surface of the of the mesh panel to remove dirt, grass, or debris with such cleaning facilitated by the cleaning solution or solvent provided by the absorbent panel. Any dirt, grass, or debris removed from the golf club head or golf ball during cleaning is retained within the liquid-impervious container.

In a second embodiment of the invention, the device is comprised of a rectangular sack having two rectangular panels joined in mirror arrangement. The panels are configured into an elongate shape and having a tapered section located at the medial portion of the panels. An opening with adjacent VELCRO® fastener allows access into an interior compartment situated between the panels. A liquid-impervious container holding a mesh panel and absorbent panel is disposed within the interior compartment. As such, the device can be wrapped around the neck or over the shoulder of a user so that the user can insert a golf club head or golf ball between the mesh and absorbent panels located within the liquid-impervious container for cleaning of said golf club head and golf ball.

The device in a third embodiment thereof is configured into a relatively compact design for insertion into a pocket of an article clothing or attachment to a trousers belt.

My invention, therefore, resides not in any one of these features per se, but rather in the particular combination of all of them herein disclosed. It is distinguished from the prior art in this particular combination of all of its structures for the functions specified.

In order that the detailed description of the invention may be better understood and that the present contribution to the art can be more fully appreciated, additional features of the invention will be described hereinafter. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application nor is it intended to be limiting as to the scope of the invention in any way.

OBJECTS OF THE INVENTION

Accordingly, it is an object of my version of the invention to provide a low-cost, easy-to-manufacture, and easy-to-market device for cleaning golf club heads and golf balls.

A further object of my version of the invention is to provide an easy-to-use and versatile device for cleaning golf club heads and golf balls.

A significant object of the invention is to provide a device for cleaning golf club heads and golf balls that is comprised of a rectangular sack having two rectangular panels of flexible, textile material attached in mirror engagement along a common seam at the perimeter edges thereof; an interior compartment located at one end of the panels of material and having access therein provided by an opening disposed within a panel of textile material and an adjacent VELCRO® fastener; a liquid-impervious container with access therein provided by an opening and adjacent VELCRO® fastener, said container disposed within said interior compartment and the opening of the liquid-impervious container communicating with the opening of the panel of textile material; absorbent panel folded in half within the liquid-impervious container and saturated with a cleaning solution or solvent; mesh panel folded in half and disposed within the folded absorbent panel; and means for releasably attaching the device to a golf club bag or article of clothing or the person of a golfer.

A final but very significant object of the invention is to provide a device for cleaning golf club heads and golf balls into which a golf club head or golf ball can be inserted and cleaned of dirt, grass, or debris attached thereon.

For a better understanding of the invention, its operating advantages and the specific objects attained by its uses, reference should be made to the accompanying drawings and descriptive matter in which there are illustrated preferred embodiments of the invention. The foregoing has outlined some of the more pertinent objects of the invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiments in addition to the scope of the invention illustrated by the accompanying drawings.

BRIEF DESCRIPTION OF THE DRAWINGS

The foregoing and other objects, features and advantages of the invention will become more fully understood from the following description of the preferred embodiments of the invention as illustrated in the accompanying drawings in which like reference characters refer to the same parts throughout different views. The drawings are not necessarily to scale, emphasis instead being placed upon illustrating the principles of the invention.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DRAWING REFERENCE NUMERALS

10 Device For Cleaning Golf Club Heads and Golf Balls, First Embodiment
12 Sack
14 Shorter Edge
16 Shorter Edge
18 Longer Edge
20 Longer Edge
22 First Panel
24 Grommet
26 Interior Compartment
28 VELCRO® Fastener
30 Container
32 VELCRO® Fastener
34 Absorbent Panel
36 Shorter End
38 Shorter End
40 Longer End
42 Longer End
44 Mesh Panel
46 Shorter End
48 Shorter End
50 Longer End
52 Longer End
54 Arm
56 Space
58 Clip
60 Larger Loop
62 Smaller Loop
64 Clasp
66 Second Panel
68 Seam
70 Middle Sidewall
72 Lateral Sidewall
74 Lateral Sidewall
76 Aperture
78 Aperture
80 Device For Cleaning Golf Club Heads and Golf Balls, Second Embodiment
82 Sack
84 Shorter Edge
86 Shorter Edge
88 Longer Edge
90 Longer Edge
92 Tapered Section
94 First Panel
96 Interior Compartment
98 VELCRO® Fastener
100 Second Panel
102 Seam
104 Device For Cleaning Golf Club Heads and Golf Balls, Third Embodiment
106 Sack
108 Top Edge
110 Tapered Edge
112 Bottom Edge
114 Side Edge
116 Side Edge
118 First Panel
120 Interior Compartment
122 VELCRO® Fastener
124 Second Panel
126 Seam

DETAILED DESCRIPTION OF THE PREFERRED EMBODIMENTS

A detailed description of the preferred embodiments is provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
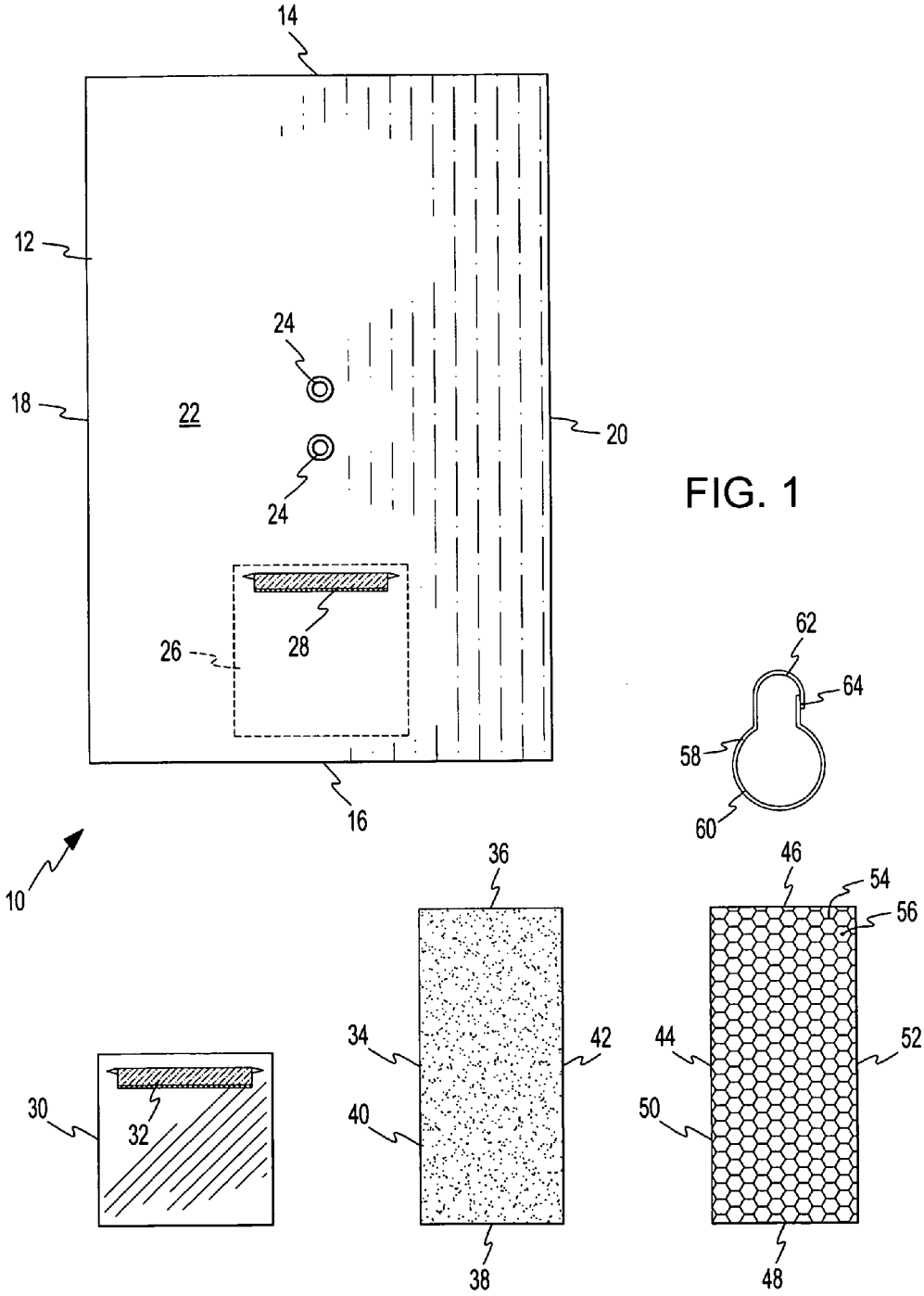
FIG. 1 is an elevation view of a first embodiment of a device for cleaning golf club heads and golf balls in accordance with the present version of the invention, illustrating the constituent components thereof.

Referring now to the drawings and, in particular, to FIG. 1 wherein there is illustrated a first embodiment of the device for cleaning golf club heads and golf balls 10. The present version of the invention 10 is designed to be releasably attached to a clip, hook, or ring of a golf club bag so that golf club heads and golf balls can be cleaned with the device 10 in a manner that does not impinge upon the playing of a golf game on a golf course. The device 10 is comprised of a flexible, rectangular sack 12 having first 14 and second 16 opposed shorter edges and first 18 and second 20 opposed longer edges. The first 14 and second 16 shorter edges are disposed in perpendicular relation to the first 18 and second 20 longer edges. The sack 12 is comprised of absorbent, flexible, textile material, such as terry cloth towel, and is approximately 16 inches wide by 24 inches long. Of course, the sack can 12 can be comprised of other suitably soft, absorbent material in varying dimensions and perimeters and remain within the spirit and scope of this version of the invention.

The sack 12 is further comprised of a first panel 22 that is attached in mirror arrangement to a second panel (not shown) so that an interior space or cavity is created between the first 22 and second panels. Two grommets 24 are located within a medial portion of the sack 12, specifically within the first panel 22 and second panel. An interior compartment 26 (shown in phantom line) is located behind the first panel 22 proximate to a shorter edge 16 thereof, and a hook and loop fastener 28 of the type well known in prior art and design and commonly referred to as VELCRO® is attached to the first panel 22 over an opening or slit situated within the first panel 22. The fastener 28 is comprised of two complementary strips that are detachably mated to each other, as shown, when closed, and separated to form an opening so as to allow access to the interior space compartment 26.

Referring again to FIG. 1, therein illustrated is a rectangular container 30 having a VELCRO® fastener 32 attached to a sidewall thereof and over an opening located within said sidewall. The fastener 32 is comprised of components strips, which function as that of the component strips of the fastener 28 described previously. The container 30 is approximately 6 inches wide by 6 inches long and is comprised of flexible, liquid-impervious material, such as clear plastic, or the like. Although the container 30 is comprised of material that provides a degree of flexibility necessary to conform to outside and inside forces impinging upon the container 30, the material is sufficiently rigid and resilient to maintain the general shape of the container 30 so as to allow said container 30 to receive cleaning components and items (golf balls, golf club heads) to be inserted therein and cleaned by said cleaning components.

A first rectangular panel 34 is illustrated and is comprised of first 36 and second 38 opposed shorter ends and first 40 and second 42 opposed longer ends. The panel 34 is approximately 5 inches wide by 11 inches long and is comprised of soft, liquid-absorbent material, such as sponge or the like. The absorbent material has absorbent capacity to retain a quantity of cleaning solution or solvent sufficient to effect satisfactory cleaning of a golf ball or golf club head, i.e. loosen and dissolve dirt or debris adhering to the outer surfaces thereof.

A second rectangular panel 44 is illustrated and consists of flexible mesh material having first 46 and second 48 opposed shorter ends and first 50 and second 52 opposed longer ends. The mesh material is comprised of a network of intersecting arms 54 and intervening spaces 56. The combination of the arms 54 and intervening spaces 56 furnishes a cleaning surface by which individual arms 54 of the network frictionally engage the exterior surface of a golf ball or golf club head and cut or slice into the dirt and debris attached to the surface thereof. As the arms 54 are relatively narrow and elongate, a configuration allowed by the intervening spaces 56, the arms 54 are especially effective in abrading and removing dirt and debris from the exterior surfaces of golf balls and golf club heads, especially when used in conjunction with cleaning solution contained within the first rectangular panel 34. The second panel 44 is comprised of material that is flexible yet sufficiently rigid to function as a cleaning surface, such as plastic, hard rubber, and the like. The panel 44 is approximately 5 inches wide by 11 inches long, although, identical in perimeter to the first panel 34.

An attachment clip 58 consists of a first loop 60, second loop 62, and clasp 64 and is inserted through the grommets 24 of the device 10 when the sack 12, i.e. first 22 and second panels, is folded in half so that the grommets 24 co-align. Once the clip 58 is inserted through the grommets 24, the device 10 with the sack 12, i.e. first 22 and second panels, folded in half can be releasably attached to a golf club bag.

Figure 2:
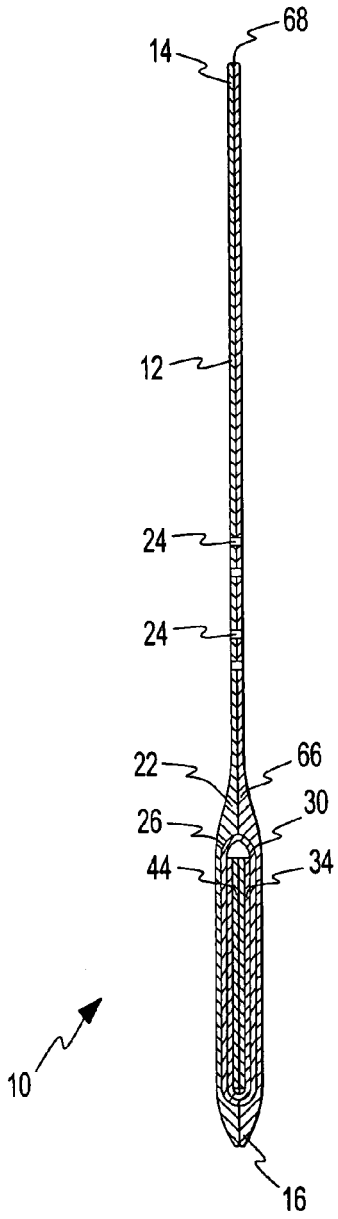
FIG. 2 is a cross-sectional view of a first embodiment of a device for cleaning golf club heads and golf balls in accordance with the present version of the invention.

Referring to FIG. 2, therein illustrated is a cross sectional view of the device 10 revealing the location of container 30, absorbent panel 34, and mesh panel 44 when assembled within the device 10. The first panel 22 is attached to a second panel 66 in mirror arrangement at seam 68 with the interior compartment 26 located proximate to a shorter edge 16 thereof and enclosing a space sufficient to hold the container 30 with the absorbent panel 34 and mesh panel 44 folded in half and inserted therein. The first panel 22 and second panel 66 are attached at seam 68 by various means, such as stitching, chemical and thermal bonding, and the like.

Figure 3:
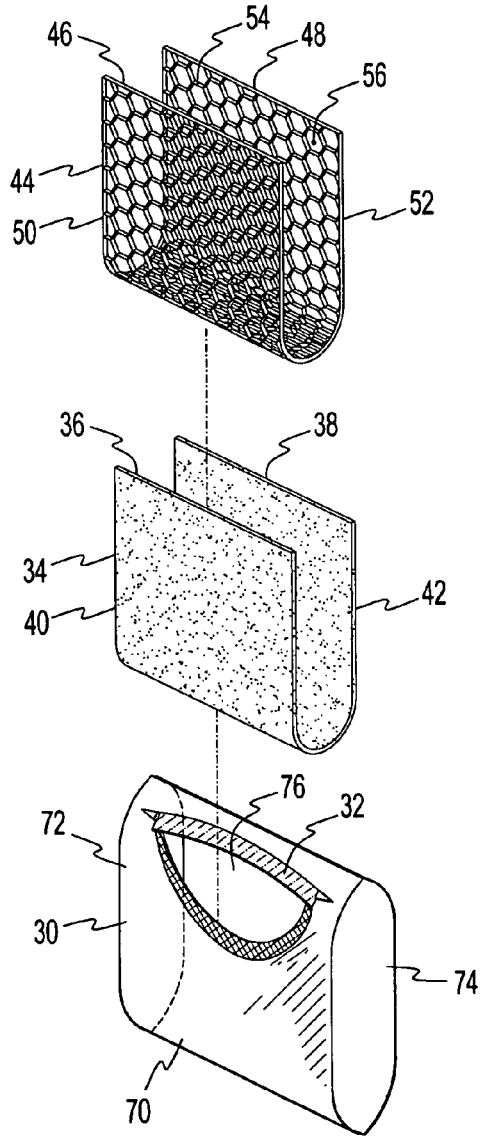
FIG. 3 is a perspective view of mesh panel and absorbent panel configured and aligned for insertion into a container before placement of mesh panel, absorbent panel, and container into the interior compartment of the device.

As shown in detail in FIG. 3, the mesh panel 44 is folded in half and aligned to be inserted within the space enclosed by the folded absorbent panel 34. Similarly, the absorbent panel 34, folded in half, is aligned to be inserted into the interior of the liquid-impervious container 30. As illustrated, the liquid-impervious container 30 is comprised of a middle, continuous sidewall 70, first lateral sidewall 72, and second, opposed lateral sidewall 74. The sidewalls 70, 72, 74 enclose an interior space or volume sufficient to contain the folded mesh panel 44 and absorbent panel 34. The folded panels 34, 44 are inserted through an aperture 76 located between the VELCRO® fastener 32, the two strips of which have been detached to form said aperture 76 of the liquid-impervious container 30. After the absorbent panel 34 and mesh panel 44 are situated within the container 30, a quantity of cleaning solution or solvent can be deposited onto the absorbent panel 34 for absorption therein. The absorbent panel 34 and mesh panel 44 are provided with a length and width that permits said panels 34, 44, when folded as illustrated, to completely enclose a golf ball or golf club head in order to perform complete and thorough cleaning thereof.

Cleaning action occurs when a golf club head or golf ball is inserted into the space enclosed by the folded mesh panel 44 and the golf club head or golf ball is frictionally engaged against the irregular surface of the mesh panel 44, i.e. the network of elongate, narrow arms 54 and intervening spaces 56, to remove dirt, grass, or debris from the golf club head or golf ball with removal of said dirt, grass, or debris facilitated by cleaning solution or solvent of the absorbent panel 34 making contact with the exterior surface of the golf club head or golf ball.

Figure 4:
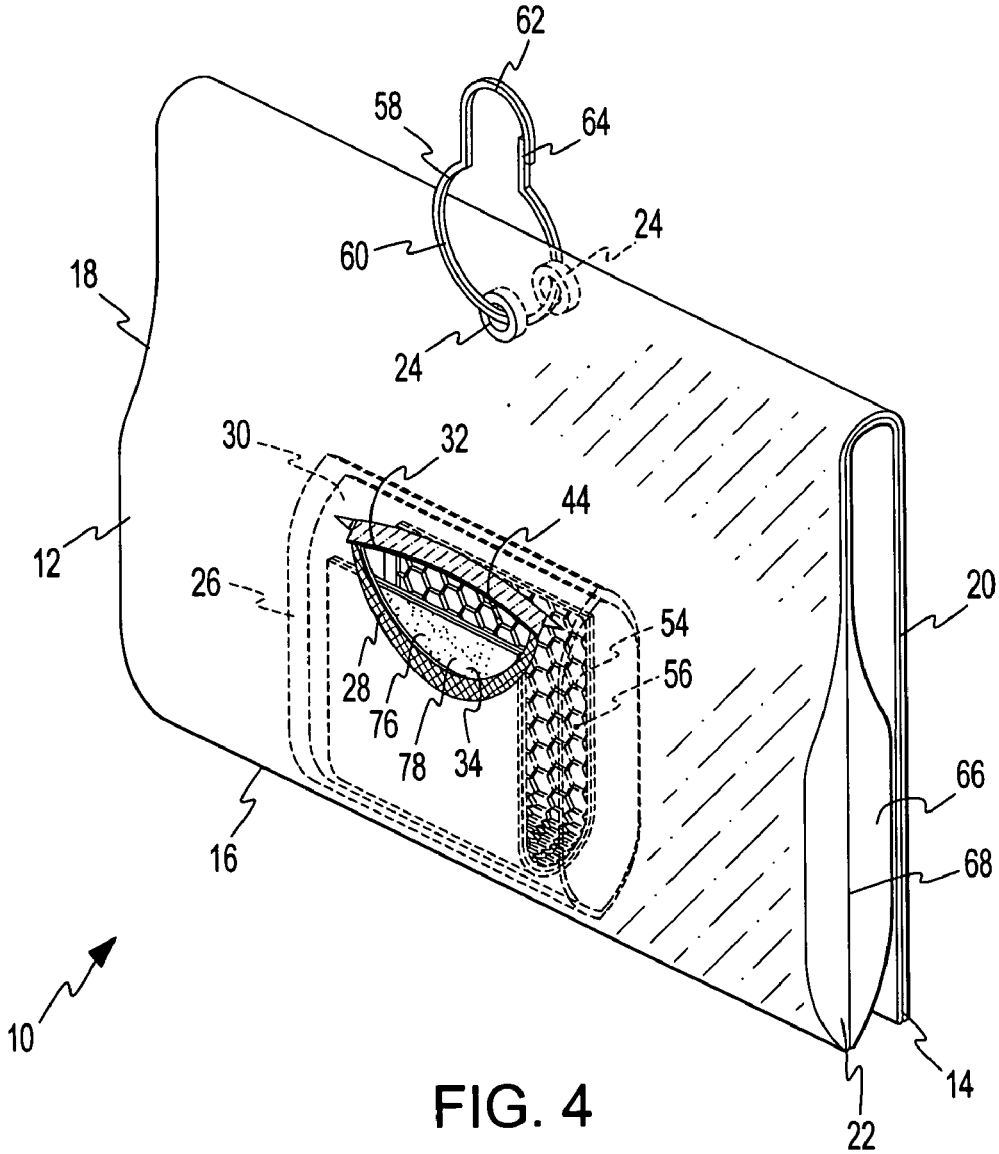
FIG. 4 is a perspective view of a first embodiment of a device for cleaning golf club heads and golf balls with the mesh panel, absorbent panel, and liquid-impervious container situated within the interior compartment of the device between the first and second panels thereof, the VELCRO® fasteners of the liquid-impervious container and the first panel of the device opened to receive a golf club head or golf ball between the mesh panel.

The fully assembled device 10 is illustrated in FIG. 4 as configured for releasable attachment to a golf club bag (not shown). The sack 12, i.e., first 22 and second 66 panels, is folded in half so that the grommets 24 co-align. The clip 58 is inserted into the co-aligned grommets 24 with the larger lip 60 generally occupying the apertures of the grommets 24. The clip 58 (and device 10) can be releasably attached to a golf club bag by separating the clasp 64 and hanging the clip 58 through an aperture and onto a hook or clip of the golf club bag by the smaller loop 62. The VELCRO® fastener 28 of the first panel 22 is opened to provide a gap or aperture 78 for access to the interior compartment 26. Similarly, the VELCRO® fastener 32 of the liquid-impervious container 30 is opened to provide the gap or aperture 76 for access to the interior thereof and into the space enclosed by the folded mesh panel 44. Once a golf club head or golf ball is inserted between the folded sidewalls of the mesh panel 44, the VELCRO® fastener 32 of the container 30 and the VELCRO® fastener 28 of the first panel 22 can be closed as appropriate when cleaning commences to ensure adequate and uniform cleaning and to prevent dirt, grass, debris, or cleaning solution escaping from the container 30.

Figure 5:
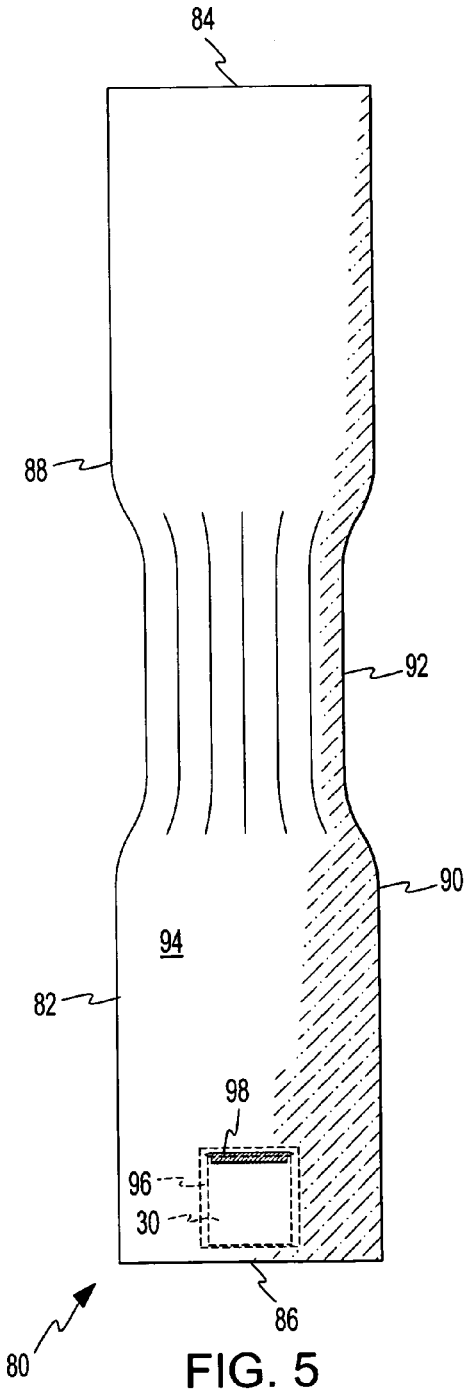
FIG. 5 is an elevation view of a second embodiment of a device for cleaning golf club heads and golf balls in accordance with the present version of the invention.

A second embodiment of the device 80 is illustrated in FIG. 5. The device 80 is designed to be wrapped or draped around the neck or shoulder of the user and is thus comprised of a rectangular sack 82 of absorbent, flexible, textile material, such as terry cloth towel approximately 16 inches wide by 72 inches long and having first 84 and second 86 opposed shorter edges and first 88 and second 90 opposed longer edges. Tapered edges 92 are located at the medial section of the sack 82. The sack 82 is comprised of a first panel 94 and a second panel, which together enclose an interior space or compartment 96 (shown in phantom line) located proximate to the shorter edge 86 of the device 80. The compartment 96 possesses a volume sufficient to hold the container 30 with an absorbent panel 34 and mesh panel 44 folded in half and inserted therein. A VELCRO® fastener 98 is attached to the first panel 94 over an opening situated within the first panel 94, said opening communicating with the interior compartment 96.

Figure 6:
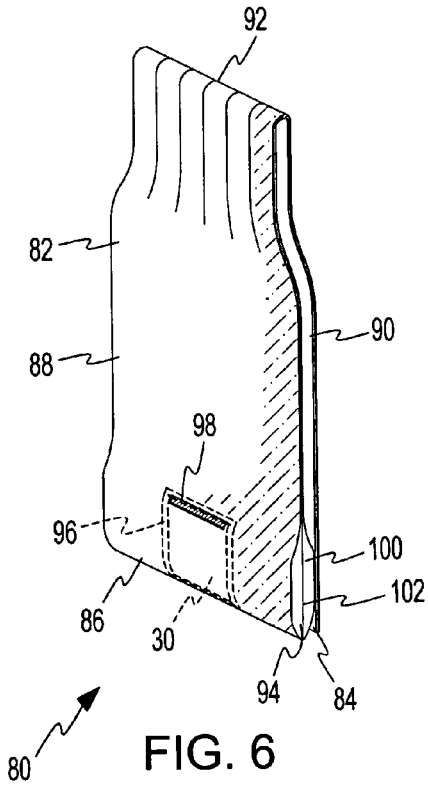
FIG. 6 is a perspective view of a second embodiment of a device for cleaning golf club heads and golf balls in accordance with the present version of the invention.

As displayed in FIG. 6, the device 80 is illustrated as folded in half at the tapered section 92 thereof for wrapping around the neck or draping over the shoulder of a user with the device 80 substantially being supported upon the user at the tapered section 92 thereof. The first panel 94 is attached in mirror arrangement to a second panel 100 at seam 102. The panels 94, 100 are attached to each other at seam 102 by various means, such as stitching, chemical and thermal bonding, and the like. A liquid-impervious container 30, which houses the absorbent 34 and mesh 44 panels, is situated within the interior compartment 96.

Figure 7:
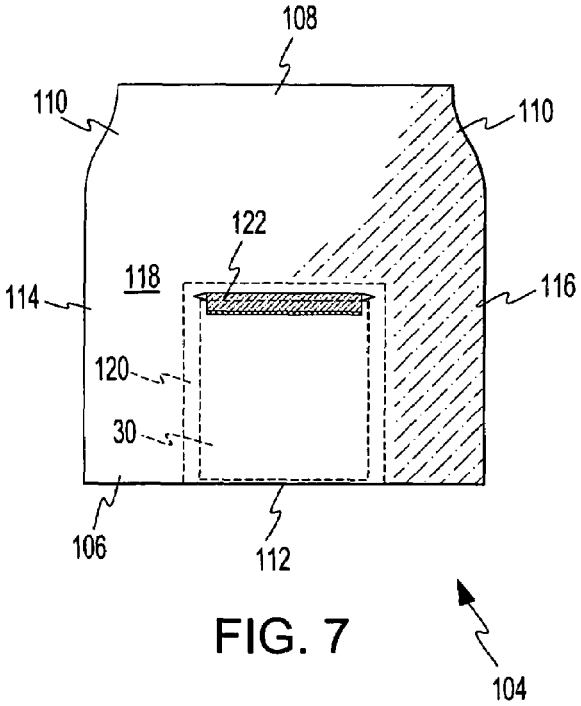
FIG. 7 is an elevation view of a third embodiment of a device for cleaning golf club heads and golf balls in accordance with the present version of the invention.

A third embodiment of the device 104 is illustrated in FIG. 7. The device 104 is designed to be folded and inserted into the pocket or between the belt and trousers of the user. The device 104 is comprised of a rectangular sack 106 of absorbent, flexible, textile material, such as terry cloth towel approximately 12 inches wide by 12 inches long and having a top, first edge 108 with flanking tapered edges 110, opposed bottom edge 112 and first 114 and second 116 opposed lateral side edges. The sack 106 is comprised of a first panel 118 and a second panel, which together enclose an interior space or compartment 120 (shown in phantom line) located proximate to the shorter edge 112 of the device 104. The compartment 120 possesses a volume sufficient to hold the container 30 with an absorbent panel 34 and mesh panel 44 folded in half and inserted therein. A VELCRO® fastener 122 is attached to the first panel 118 over an opening situated within the first panel 118, said opening communicating with the interior compartment 120.

Figure 8:
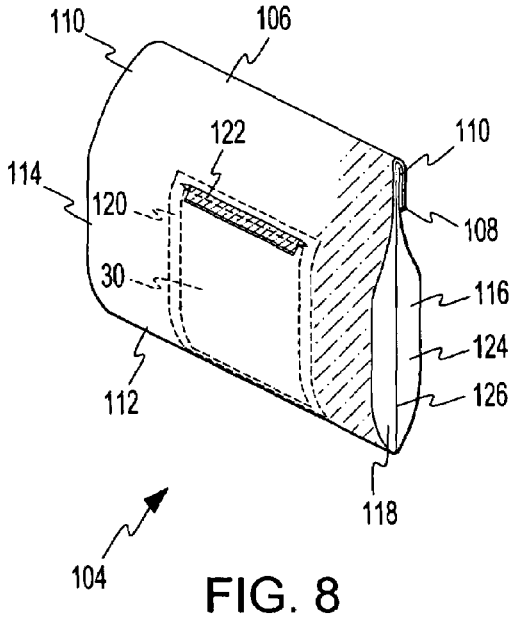
FIG. 8 is a perspective view of a third embodiment of a device for cleaning golf club heads and golf balls in accordance with the present version of the invention.

As shown in FIG. 8, the first panel 118 is attached in mirror arrangement to a second panel 124 at seam 126. The first panel 118 and second panel 124 are attached at seam 126 by various means, such as stitching, chemical and thermal bonding, and the like. The VELCRO® fastener 122 is attached to the first panel 118 over an opening situated within the first panel 118, said opening communicating with the interior compartment 120. The liquid-impervious container 30, which houses the absorbent 34 and mesh 44 panels, is situated within the interior compartment 120. The device 104 is illustrated with the top edge 108 and flanking tapered edges 110 folded back upon the second panel 124 so that the device 104 can be inserted into the pocket of a user or between the trousers and belt of a user at the edge 108 thereof.

While this version of the invention has been illustrated and described in detail in the drawings and foregoing description, the same is to be considered as illustrative and not restrictive in character, it being understood that only the preferred embodiments have been shown and described and that all changes and modifications that come within the spirit of the version of the invention are desired to be protected. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

CONCLUSION AND SCOPE OF INVENTION

From the foregoing, it will be understood by persons skilled in the art that an improved device for cleaning golf club heads and golf balls has been provided. The invention is relatively simple and easy to manufacture, yet affords a variety of uses. While my description contains many specificities, these should not be construed as limitations on the scope of the version of the invention, but rather as an exemplification of the preferred embodiments thereof. The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention. Although this invention has been described in its preferred form with a certain degree of particularity, it is understood that the present disclosure of the preferred form has been made only by way of example and numerous changes in the details of construction and combination and arrangement of parts may be resorted to without departing from the spirit and scope of the invention.

While the invention has been described in connection with the preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A device for cleaning golf balls and golf club heads, comprising:

a generally rectangular sack of flexible, absorbent material, said sack having first and second opposed shorter edges and first and second opposed longer edges and further comprised of a first, rectangular panel and a second, rectangular panel, said panels joined in mirror engagement by fastening means at a common seam along perimeter edges thereof and enclosing an interior compartment, said interior compartment located proximate to one shorter edge of said sack;

means to releasably attach said device to a golf club bag;

an opening located within the first panel over the interior compartment so as to permit access to said interior compartment;

fastening means surrounding said opening, said fastening means attached to said first panel around the boundary of said opening, said fastening means able to be configured so as to open or close said opening;

a liquid impervious container having a middle continuous sidewall and opposed lateral sidewalls and located within said interior compartment, an opening located within the middle continuous sidewall of said container, said opening surrounded by fastening means attached to the middle continuous sidewall around the boundary of said opening, said fastening means able to be configured so as to open or close said opening, said opening further co-aligned with the opening of the first panel so that engaging the fastening means to expand opening of the first panel of material permits access to fastening means of said container and engaging fastening means around opening of said container permits access to interior of said container;

a generally rectangular flexible panel comprised of soft, absorbent material, said panel having first and second opposed shorter edges and first and second longer edges;

a generally rectangular flexible mesh panel, said mesh panel having first and second opposed shorter edges and first and second longer edges, said mesh panel further comprised of flexible, resilient material, said material yet sufficiently rigid to perform a cleaning function, said mesh panel further possessing a perimeter similar to that of said panel of absorbent material, wherein said mesh panel and panel of absorbent material both folded in half and situated within the container, said mesh panel folded in half and disposed within the interior of the panel of absorbent material; and said openings of said first panel of material and container able to opened by operation of the fastening means surrounding said openings so as to receive a golf ball or golf club head for insertion into and between the folded mesh panel located within the container so that cleaning of dirt and debris attached to the surface exteriors thereof can by accomplished by the combination of cleaning solution transferred from said absorbent panel to dirt and debris on exterior surface of golf ball and golf club head to loosen and soften said dirt and debris, which is scraped from said exterior surfaces by the mesh surface of mesh panel making contact with said surfaces of golf ball and golf club head while said golf ball and golf club head is agitated against the mesh surface of said mesh panel.

2. The device for cleaning golf balls and golf club heads as recited in claim 1, in which said sack has a perimeter of approximately 16 by 24 inches.

3. The device for cleaning golf balls and golf club heads as recited in claim 1, in which said fastening means for said first and second panels of flexible material joined at a common seam thereof is comprised of stitching, chemical and thermal adhesion, bonding, and the like.

4. The device for cleaning golf balls and golf club heads as recited in claim 1, in which said means to releasably attach said device to a golf club bag is comprised of a pair of grommets and a clip, each grommet enclosing an aperture and attached to medial sections of the first and second panels of material of said sack and co-aligned in juxtaposition thereon so that when said first and second panels of said device are folded in half said grommets co-align, and said clip can be inserted therethrough.

5. The device for cleaning golf balls and golf club heads as recited in claim 4, in which said clip is further comprised of a first larger loop, a second smaller loop, and a clasp, said larger loop occupying said grommets of the device when said first and second panels of the device are folded in half and said device is releasably attached to and suspended from a golf bag, said second smaller loop secured to a clip, hook, or ring of said golf club bag.

6. The device for cleaning golf balls and golf club heads as recited in claim 1, in which said fastening means surrounding said opening of said first panel of the device is comprised of a hook and loop fastener, said fastener further comprised of first and second complementary strips located on opposed sides of said opening and detachably mated to each other to close said opening and separated from each other to open said opening.

7. The device for cleaning golf balls and golf club heads as recited in claim 1, in which said fastening means surrounding said opening located on the middle continuous sidewall of the container is comprised of a hook and loop fastener, said fastener further comprised of first and second complementary strips located on opposed sides of said opening and detachably mated to each other to close said opening and separated from each other to open said opening.

8. The device for cleaning golf balls and golf club heads as recited in claim 1, in which said mesh panel is comprised of a network of elongate, narrow arms and spaces alternating therebetween, said narrow arms providing a cutting edge that slices through, abrades, and removes dirt and debris adhered to the surface of a golf ball or golf club when said golf ball or golf club is inserted between the mesh panel, said mesh panel enclosed by said absorbent panel, both of which are located within said container.

* * * * *

UNITED STATES PATENT AND TRADEMARK OFFICE

CERTIFICATE OF CORRECTION

PATENT NO. : 7,484,262 B2
APPLICATION NO. : 10/856875
DATED : February 3, 2009
INVENTOR(S) : David Cotton It is certified that error appears in the above-identified patent and that said Letters Patent is hereby corrected as shown below:

On the Title Page, Item -57- Abstract:
Line 15, “mash” should be --mesh--.
Line 23, “are” should be --is--.

Column 1:
Line 19, “gall” should be --ball--.
Line 23, “golfball...golfturfand” should be --golf ball...golf turf and--.
Line 45, “golfball...ofbristles” should be --golf ball...of bristles--.
Line 46, “makes” should be --make--.

Column 2:
Line 1, “gross” should be --grass--.
Line 3, “golfball” should be --golf ball--.
Line 31, delete “to”.
Line 39, “club” should be --Club--.

Column 3:
Line 23, “to inserted” should be --to be inserted--.
Line 38, delete “of the” (2nd occurrence).
Line 60, after “article” insert --of--.

Column 4:
Line 44, “golfballs” should be --golf balls--.

Column 5:
Line 32, “golfballs” should be --golf balls--.

Column 7:
Line 20, delete “can” (1st occurrence).

UNITED STATES PATENT AND TRADEMARK OFFICE

CERTIFICATE OF CORRECTION

PATENT NO. : 7,484,262 B2
APPLICATION NO. : 10/856875
DATED : February 3, 2009
INVENTOR(S) : David Cotton It is certified that error appears in the above-identified patent and that said Letters Patent is hereby corrected as shown below:

Column 11:
Line 28, "around opening of said container permits access to interior" should be --around the opening of said container permits access to the interior--.
Line 45, after "able to" insert --be--.
Line 50, "by" should be --be--.
Line 52, after "on" insert --the--.
Line 52, after "on" insert --the--.

Signed and Sealed this

Twenty-second Day of September, 2009

David J. Kappos

David J. Kappos
*Director of the United States Patent and Trademark Office*